US006314659B1

(12) United States Patent
Parker

(10) Patent No.: US 6,314,659 B1
(45) Date of Patent: Nov. 13, 2001

(54) DEVICE AND METHOD FOR PROTECTING A CARRYING FABRIC

(75) Inventor: Richard A. Parker, Cape Elizabeth, ME (US)

(73) Assignee: Valmet Inc., Biddeford, ME (US)

( * ) Notice: Subject to any disclaimer, the term of this patent is extended or adjusted under 35 U.S.C. 154(b) by 0 days.

(21) Appl. No.: 09/465,971

(22) Filed: Dec. 14, 1999

(51) Int. Cl.[7] ..... F26B 5/04

(52) U.S. Cl. ..... 34/414; 34/419; 34/429; 34/465; 34/114

(58) Field of Search ..... 34/414, 419, 428, 34/429, 465, 110, 114, 116, 124, 640, 643, 644; 162/206, 207, 358.5, 359.1; 26/18.5, 18.6

(56) References Cited

U.S. PATENT DOCUMENTS 3,590,495 * 7/1971 Tyson ..... 34/643
4,411,051 * 10/1983 Ehemann ..... 26/18.5
4,562,627 * 1/1986 Milligan ..... 26/18.5
5,347,726 * 9/1994 Quadracci et al. ..... 34/465
5,536,158 * 7/1996 Dresie et al. ..... 34/630 X
5,588,223 * 12/1996 Marshall ..... 34/414
5,619,808 * 4/1997 Pabst ..... 34/640
5,667,641 * 9/1997 Poirier et al. ..... 162/207
5,799,411 * 9/1998 Schiel ..... 34/446
6,108,936 * 8/2000 Vuorinen ..... 34/425

* cited by examiner

*Primary Examiner*—Stephen Gravini
(74) *Attorney, Agent, or Firm*—Joseph W. Molasky & Associates

(57) ABSTRACT

A device and method for extending the useful life of a carrying fabric in a dryer by maintaining the edges of the fabric at a temperature below that at which thermal degradation occurs. This is achieved by applying a cooling liquid to the edges of the carrying fabric so that thermal energy can be transferred from the fabric to the liquid and thus maintain the edges of the fabric at moderate temperatures.

18 Claims, 3 Drawing Sheets

DEVICE AND METHOD FOR PROTECTING A CARRYING FABRIC

This invention relates to a device and method for extending the useful life of a carrying fabric in web processing as, for example, in the manufacture of paper and textiles. More specifically, this invention extends the life of a carrying fabric by applying a cooling liquid to those edges of the fabric which are uncovered by the web and which remain exposed to high operating temperatures during the drying operation.

The invention described herein makes reference to a through-air dryer; however, this is for illustration only and in practice, this invention may employ other known drying means as, for example, dryers of the flat-bed type; a drying system in which a series of small diameter rolls is used to convey the product through a drying hood.

The products produced by this invention are widely used in home and industry and include, for example, kitchen towels, bathroom tissue and facial tissue.

This invention also has application in the treatment of nonwoven fabrics, that is, fabrics composed of fibers which are in random array. Included in this category are fibers obtained from any type of loose fibrous web, batt or sheet. Moreover, the fibers may be straight or crimped and may include fiber blends. Also included are combinations of textile fibers as for example, polyester, polypropylene, rayon, nylon and the like and papermaking fibers as, for example, wood pulp or cotton linters and the like.

BACKGROUND OF INVENTION

The term "carrying fabric" as used herein is intended to include wires, screens, belts, and other web supporting means, typically made from plastics such as polyesters.

Carrying fabrics are often used in the dryer sections of paper machines or other web processes where the web is wet and lacks strength and must be supported. However, a carrying fabric is expensive not only in capital cost but also in the downtime which results when the machine must be serviced and the fabric replaced.

Accordingly, any improvement which would extend the useful life of a carrying fabric is of principal concern in the paper and textile industries and any industry where webs and films are employed.

In a through-air dryer of the rotary type, heat-generating means is used to heat and dry the web as it passes over a roll. In this system, air is drawn through the web (e.g., paper) as the result of a pressure differential across the web surface and moisture is removed by convective heat and mass transfer between the web and the air.

The roll in this system includes a cylindrical wall which is air permeable and which serves as a support for the carrying fabric. The carrying fabric, in turn, carries and supports the web. Two nip rolls hold the carrying fabric and determine the extent to which the web wraps around the roll.

The heated air for drying the web may flow from outside the cylinder to the inside as, for example, by passing the web under a heating hood or, alternatively, it may flow from in side the cylinder to the outside. In either case, the effect on the carrying fabric is the same because the heated air drawn through the roll exposes the edge of the carrying fabric to the degrading effects of unremittingly high operating temperatures.

The drying time for the web depends upon the desired degree of drying, the speed of the line, the amount of heat applied and the volume of air which is drawn through the fabric. Since it is more energy efficient and cost effective to heat air than move it, it is preferable to increase the operating temperature of the dryer and minimize air volume. Moreover, as the line speed increases, so does the need to remove water. Therefore, it is desirable to operate dyers at higher temperatures as the line speed increases.

Operating a dryer at higher temperatures, however, reduces the life of the carrying fabric because it thermally degrades the fabric's edge. Fabric degradation is a function of fabric temperature and the period of time over which the fabric is exposed to high temperatures. Accordingly, any means which provides for a decrease in fabric temperature and limits the exposure of the fabric to the degrading effects of high temperature will extend fabric life.

In a typical system, for example, hot air is supplied at temperatures in the range of from about 350–520° F.; however, when this heated air passes through the wet web, it picks up moisture and the temperature is greatly reduced. As a result, the air which passes through the web-covered fabric is in the range of about 190–250° F., whereas, the temperature of the air which passes through those fabric are as not covered by the web is usually within the 350–520° F. range. Accordingly, those are as of the carrying fabric which are not covered by the web receive the impact of high heat and suffer its degrading effect. On the other hand, those are as of the carrying fabric which are web-covered are protected because the moisture in the web exerts a cooling effect which is transmitted to the fabric's interior.

Accordingly, unless adequate cooling is provided, the exposed edge of the carrying fabric will be thermally degraded and the useful life of the entire fabric will be severely limited.

Moreover, excessively high temperatures may even cause the fabric to melt and/or catastrophically fail and this can result in significant downtime and expense.

Accordingly, there is a need to extend the life of a carrying fabric by moderating the temperatures to which its exposed edges are subjected during the drying operation.

Various devices and methods for reducing the temperature of a fabric's edge are known in the art but they are unsatisfactory. One such method directs a "curtain" of cool air along the edge of the fabric. This cool air, typically ambient air, is blown down from a separately contained supply section housed within a hood and it cools the edge and protects it from the otherwise hot air that blows over the web.

Another method provides for the application of suction means to the edge of the roll so that ambient air can be drawn in from the side between the hood and roll. As the ambient air passes through the fabric, it cools the edge.

Still another method prevents suction from being drawn over the edge of the roll by placing a sleeve under the exposed edge of the fabric. The reasoning is that, since the hot air which emanates from the hood is prevented from passing through the roll, it cannot pass through the carrying fabric. The convective heat transfer between the air and fabric is therefore less than it would be if the air were allowed to pass through the fabric. Consequently, the rate of rise of fabric temperature is less when this method is employed.

Another method for preserving the carrying fabric is simply to reduce the operating temperature of the dryer.

Although these methods are of some benefit in reducing degradation of the fabric's edge, each has its shortcomings.

For example, the use of ambient air to shield or cool the exposed edge of a fabric has limited value because air has a limited capacity to absorb heat. The alternative is to reduce the temperature at which the dryer may operate; however, the result is a reduction in line speed.

Also, the use of a sleeve to prevent hot air from passing through the carrying fabric will moderate only slightly the effects attributed to heat and the surface of the fabric will still remain exposed to the degrading effects of high temperatures.

Moreover, it has been found that the level to which temperatures must be reduced to dry paper and minimize damage to the carrying fabric, is of such magnitude that either the air volume must be increased or the line must be slowed. However, an increase in drying air volume can only be achieved by the use of motors and electricity and this is less cost effective than using fuels such as natural gas or oil to operate at higher temperatures. Since, however, the object in web processing is to maximize paper production, any slowing of the line speed would be counterproductive.

Accordingly, a need exists for protecting the exposed edge of a carrying fabric by minimizing the effects of thermal degradation while at the same time, avoiding any increase in air volume or decrease in line speed.

SUMMARY OF THE INVENTION

This invention provides an apparatus and method for extending the useful life of carrying fabric in a dryer by maintaining the fabric edge at temperatures that minimize the effects of thermal degradation. This is achieved by applying a cooling liquid to the edge of the carrying fabric.

Any number of cooling liquids may be employed; however, the object of this invention is to cool by evaporation and, therefore, it is desirable to employ liquids which possess a relatively high latent heat value.

Latent heat is the quantity of energy absorbed or given off when a substance undergoes a change of state as, for example, from a liquid to a gas. Water has an unusually high latent heat value (540 cal/g) and, therefore, it is particularly suitable as a cooling liquid because it can absorb appreciable amounts of heat and thus reduce the temperature of the fabric edge to moderate levels. Organic liquids such as alcohols and the like also have a desirable latent heat levels but aqueous solutions comprised principally of water are preferred.

Once the fabric has been thoroughly wet with liquid (i.e., water), the tendency is for both fabric and water to reach an equilibrium by arriving at a common temperature. Since the water which is applied has a temperature which is appreciably less than that of the fabric, it will draw heat energy from the fabric and continue to do so until it reaches evaporation temperature (212° F. at sea level). Moreover, the water will remain at evaporation temperature until there has been a transfer of energy sufficient to convert the liquid water to its gaseous state.

Accordingly, the water which is applied to the fabric edge, protects in two ways, first by absorbing heat energy at a rate which increases the water temperature to 212° F. (evaporation temperature) and, secondly, by absorbing the additional energy needed to convert it from a liquid to a gas.

Since the object of this invention is to cool by evaporation, it is important that water be applied to the fabric edge in a manner which will ensure a thorough wetting of the fabric surface. This can be achieved by spray means or by the use of rolls and the like; however, spraying is preferred.

In practice, according to one embodiment of this invention, the liquid is applied by means of a nozzle which is positioned at the edge of the carrying fabric proximate to the dryer in such manner that the nozzle sprays the liquid onto the terminal end segment or fabric edge. In a dryer equipped with a roll and a hood, where the hood covers a portion of the roll, the liquid may be applied by utilizing a multiplicity of nozzles. In this multi-nozzle arrangement, at least a portion of the nozzles are mounted to the hood proximate to the edge of the fabric. Also, if desired, the cooling step may be applied prior to the dryer to ensure that the carrying fabric enters the dryer in a sufficiently wet condition.

BRIEF DESCRIPTION OF THE DRAWINGS

This invention will now be described by reference to the accompanying drawings and following text; where like numerals identify like elements.

DESCRIPTION OF THE PREFERRED EMBODIMENT

This invention relates to a device and method for extending the useful life of a carrying fabric in a dryer by maintaining the edges of the carrying fabric at temperatures that serve to minimize thermal degradation. Functionally, this is achieved by applying a cooling liquid to the fabric edge. This device has particular application in the dryer sections of a paper machine where high operating temperatures are typically encountered; however, it should be understood that this invention may also be employed in any system where a process web or film leaves a portion of the carrying fabric exposed to high temperatures.

The means by which the cooling liquid is brought in to contact with the carrying fabric may be any device known in the art for applying either liquid or vapor to a moving surface. In a preferred embodiment, this contact or application means comprises at least one nozzle positioned proximate to the dryer such that the nozzle sprays the liquid on to the edge of the fabric a sit passes by.

Figure 1:
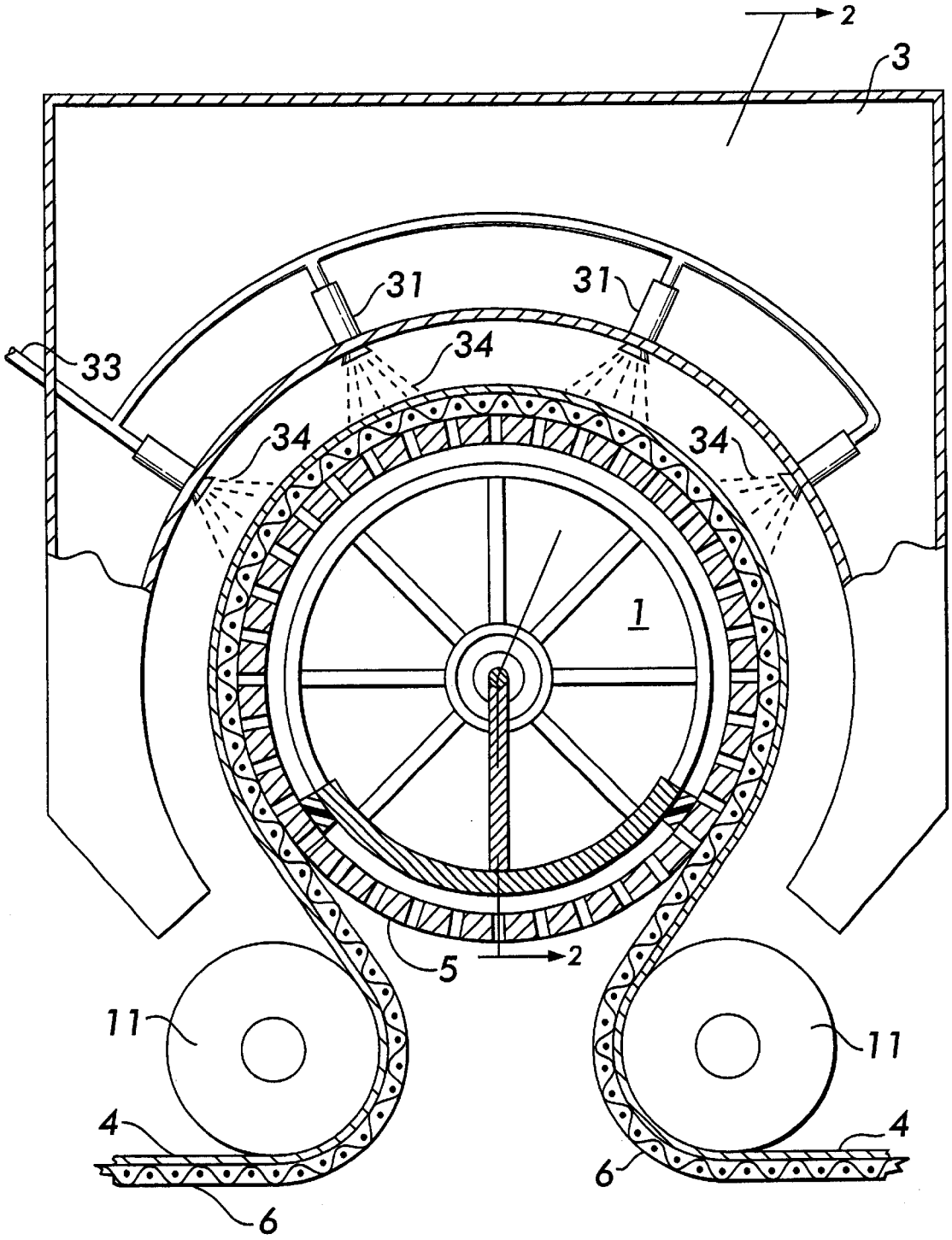
FIG. 1 is an elevational front view of the dryer assembly of this invention showing a spray nozzle array.
Figure 2:
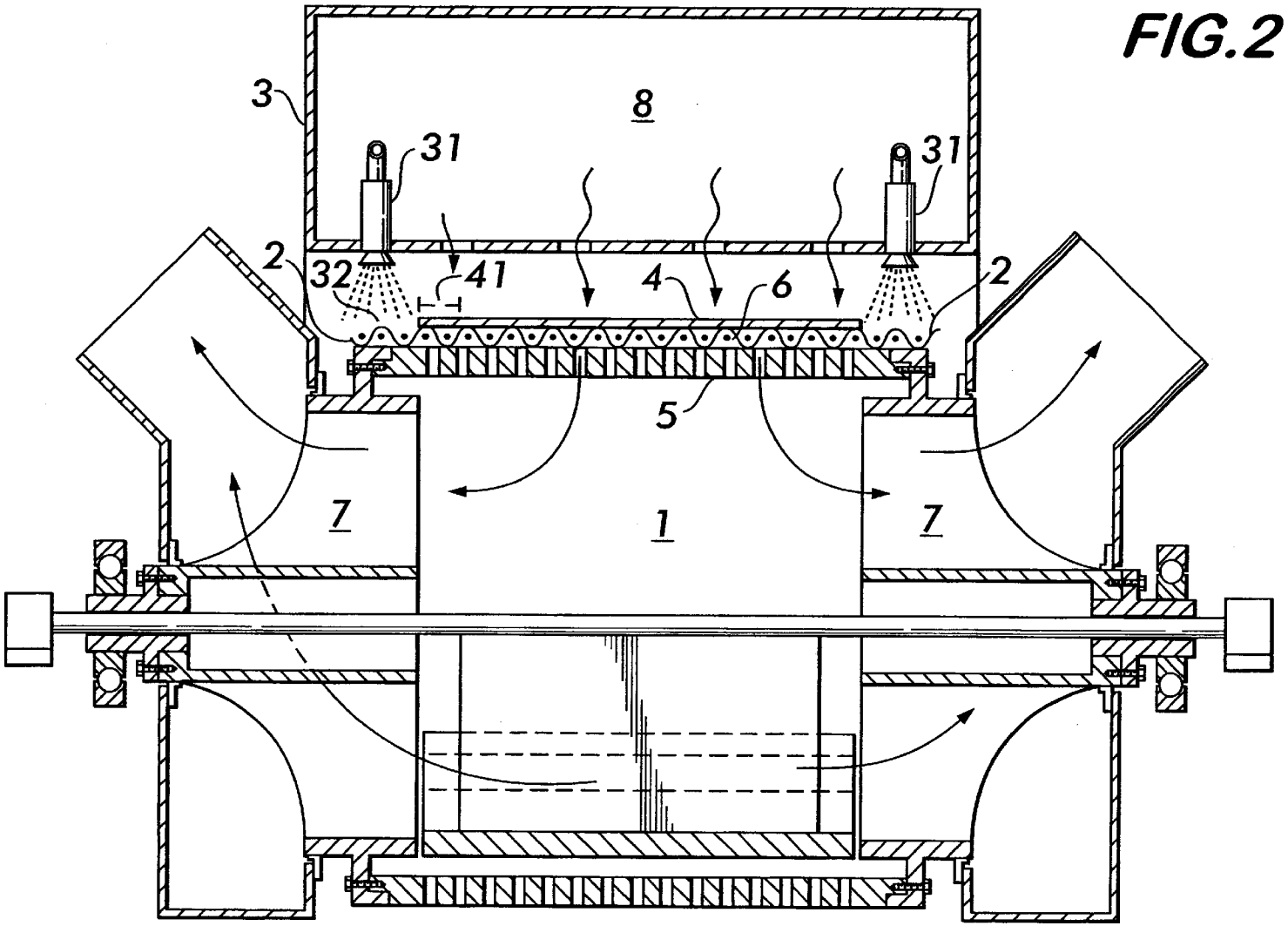
FIG. 2 is a front sectional view taken along line 2—2 of FIG. 1.

This embodiment is illustrated by FIGS. 1 and 2 which show a dryer for drying a web 4 and a carrying fabric 6 beneath the hood 3. The web and carrying fabric are supported by a roll 1 having a cylindrical outer wall 5 which is air permeable so that heated air 8 from the hood 3 may pass through the web 4, through the carrying fabric and then through the cylinder wall 5.

As shown in FIG. 1, the hood 3 covers only a portion of the roll 1 so that, as a practical matter, the heated air 8 comes in to drying contact only with those areas of the web and carrying fabric which are supported by the roll 1.

Two nip rolls 10 and 11, one on the entry side of the dryer, the other on the exit side, hold the web and carrying fabric and determine the extent to which they are fed on to the roll. Once they are within the dryer, the heated air from the hood passes through the web 4, through the carrying fabric 6 and through cylinder wall 5 before exiting via ducts in the side walls 7. In known systems, this drying step exerts a degrading effect on those portions of the carrying fabric which are not covered by the web. Over a period of time, their exposure to high heat weakens the fabric fibers and causes it to degrade.

The present invention solves this problem by contacting the exposed portions of the fabric with a liquid (i.e., coolant) which has the ability to draw heat away from the carrying fabric and into the liquid. Moreover, the nature of the coolant is such that this heat transfer continues until the liquid absorbs whatever degree of latent heat is needed to convert it in to a gas (i.e., vapor).

In the present invention, this liquid contacting step is achieved by mounting within the drying hood a multiplicity of nozzles 31 which are positioned proximate to the exposed edge of the fabric and along the perimeter of the roll as shown in FIG. 2. As roll 1 and the carrying fabric 6 move in to the hood, the nozzles 31 spray the liquid 34 on to the exposed edges 2 of the fabric and the spraying is continued at the frequencies needed to avoid thermal degradation. The liquid 34 is supplied to the spray nozzles by the supply conduit shown as piping 33 in FIG. 1.

Figure 3:
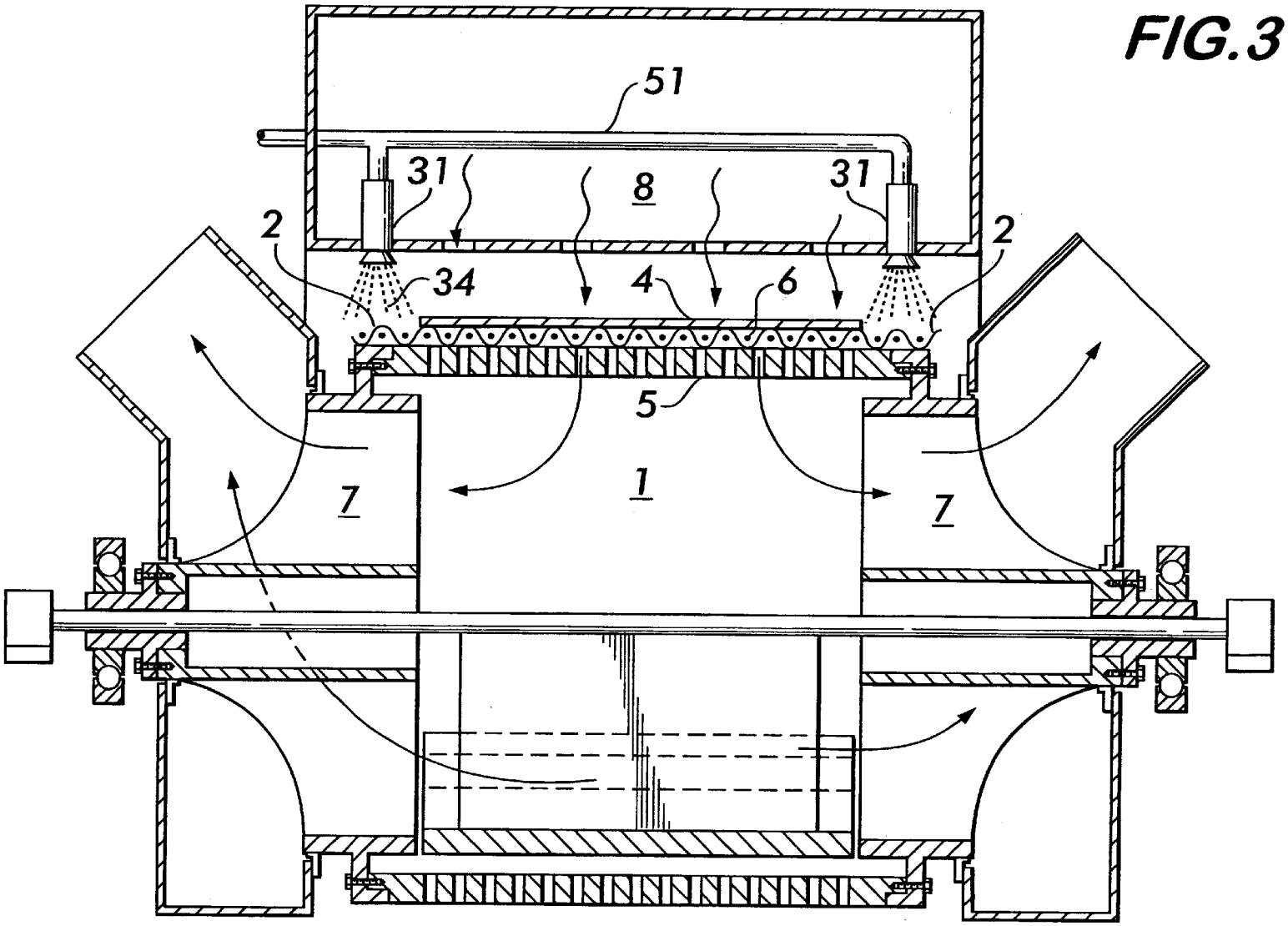
FIG. 3 is a front cross-sectional view of a dryer assembly of this invention showing an alternative spray nozzle arrangement.

FIG. 3 shows an alternate type of conduit comprised of a pipe 51 which traverses the web 4 so as to provide nozzles on either side of web 4.

A typical nozzle is shown in FIGS. 1, 2 and 3; however, it should be understood that other means may also be used to bring the cooling liquid into contact with the fabric. Other typical means include, for example, a spout or a faucet that drips, pours or otherwise applies a stream of liquid onto the fabric edge as it passes through the dryer. The application of liquid may also be achieved by bringing the application means and the fabric edge into intimate contact as, for example, by the use of an applicator roll which rolls the cooling liquid directly onto the carrying fabric.

Still another embodiment provides for positioning at least one nozzle prior to the dryer and proximate to each exposed edge of the carrying fabric. As the liquid is emitted, it comes into contact with the fabric and ensures that the fabric and fabric edges will enter the dryer in the wet state.

This invention cools the exposed edge of the carrying fabric and minimizes thermal degradation by exploiting the heat capacity of the cooling liquid. Once sprayed or applied to the carrying fabric, the liquid absorbs heat and minimizes temperature increases on the fabric edge. The ideal cooling liquid is one having a relatively high latent heat capacity, that is, the liquid should have the ability to absorb heat without significantly increasing the temperature of the coolant. Typical of such liquids are, for example, those which exhibit a high latent heat of vaporization and, thus, have the ability to change from a liquid to a vapor with little or no change in temperature. Water is preferred, but it will be obvious to the artisan that other liquids such as aqueous mixtures of alcohols and the like may also be employed.

In practice, the contacting of the fabric with the liquid may result in an incidental 'wetting' of the web's edge; however, it should be noted that this does not impact negatively on the quality of the resulting product because the edge of the web 41 can be trimmed in a finishing step.

When water is not used as the cooling substance, due to process constraints or because of a concern for water damage or the like, then water in vapor form (i.e., steam) may be used instead. Steam has a significantly higher heat capacity than air and, therefore, it can be relied upon to remove more heat from the system with out any comparable increase in temperature of it sown. In a preferred embodiment, the steam employed is saturated steam employed at low temperature and low pressure.

These embodiments have been fully described and depicted for the purpose of explaining the principles of the present invention; however, it will be appreciated by those skilled in the art that various modifications and changes may also be made with out departing from the spirit and scope of this invention, and these are fully intended to be apart of this invention and with in the scope of the appended claims.

What is claimed is:

1. A device for extending the useful life of a carrying fabric in a dryer by maintaining the edges of said carrying fabric at a temperature that minimizes significant thermal degradation, said device comprising application means for applying a cooling liquid to said edges of said carrying fabric, said application means comprising at least one nozzle positioned along each edge of said carrying fabric proximate to said dryer such that said nozzle sprays said cooling liquid on to said edge of said fabric.

2. The device of claim 1, wherein said dryer has a roll and a hood, said hood covering a portion of said roll, and wherein said application means comprises a multiplicity of nozzles, at least a portion of said nozzles being mounted to said hood proximate to said edges of said fabric.

3. The device of claim 2, wherein said application means also comprises at least one nozzle positioned proximate to each edge of said fabric preceding said dryer.

4. The device of claim 1, wherein said application means comprises a conduit containing said cooling liquid and having apertures, said conduit traversing said fabric such that said apertures are positioned proximate to said edges such that said cooling liquid exits said conduit through said apertures and comes in to substantial contact with said edges.

5. The device of claim 1, wherein said application means precedes said dryer and applies said cooling liquid to a web.

6. The device of claim 1, wherein said cooling liquid is an aqueous solution.

7. The device of claim 1, wherein said cooling liquid is water.

8. The device of claim 1, wherein said cooling liquid is a vapor.

9. The device of claim 1, wherein said cooling liquid is steam.

10. A method for extending the useful life of a carrying fabric in a dryer by maintaining the edges of said carrying fabric at a temperature that minimizes significant thermal degradation, said method comprising applying a cooling liquid to said edges of said carrying fabric, said cooling liquid being applied by a nozzle along each edge of said carrying fabric proximate to said dryer such that said nozzles prays said cooling liquid onto said edge of said fabric.

11. The method of claim 10, wherein said dryer has a roll and a hood, said hood covering a portion of said roll, and wherein cooling liquid is applied by a multiplicity of nozzles, at least a portion of said nozzles being mounted to said hood proximate to said edges of said fabric.

12. The method of claim 11, wherein said cooling liquid is applied prior to said dryer.

13. The method of claim 10, wherein said cooling liquid is applied by a conduit containing said cooling liquid and having apertures, said conduit traversing said fabric such that said apertures are positioned proximate to said edges such that said cooling liquid exits said conduit through said apertures and comes into substantial contact with said edges.

14. The method of claim 10, wherein said cooling liquid is applied prior to said dryer.

15. The method of claim 10, wherein said cooling liquid is liquid.

16. The method of claim 10, wherein said cooling liquid is water.

17. The method of claim 10, wherein said cooling liquid is a vapor.

18. The method of claim 10, wherein said cooling liquid is steam.

* * * * *